US008365818B2

(12) United States Patent
Schultz et al.

(10) Patent No.: US 8,365,818 B2
(45) **Date of Patent: *Feb. 5, 2013**

(54) JARRING METHOD AND APPARATUS USING FLUID PRESSURE TO RESET JAR

(75) Inventors: Roger L. Schultz, Ninnekah, OK (US); Andrew M. Ferguson, Oklahoma City, OK (US); Michael L. Connell, Mustang, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/471,881

(22) Filed: May 15, 2012

(65) Prior Publication Data

US 2013/0000909 A1 Jan. 3, 2013

Related U.S. Application Data

(63) Continuation of application No. 13/044,785, filed on Mar. 10, 2011.

(51) Int. Cl.
*E21B 31/107* (2006.01)
*E21B 31/113* (2006.01)

(52) U.S. Cl. ..... 166/178; 175/296; 175/297

(58) Field of Classification Search ..... 166/178; 175/296, 297

See application file for complete search history.

(56) References Cited

U.S. PATENT DOCUMENTS 3,757,816 A 9/1973 Price
3,877,530 A 4/1975 Dowmen
3,955,634 A 5/1976 Slator et al.
3,974,876 A 8/1976 Taylor
3,987,858 A 10/1976 Slator et al.
4,036,297 A 7/1977 Swihart, Sr.
4,111,271 A 9/1978 Perkins
4,179,002 A 12/1979 Young
4,181,186 A 1/1980 Blanton
4,186,807 A 2/1980 Sutliff et al.
4,196,782 A 4/1980 Blanton
4,211,293 A 7/1980 Blanton (Continued)

FOREIGN PATENT DOCUMENTS

WO WO2011136830 A1 11/2011
WO WO2012018700 A2 2/2012

OTHER PUBLICATIONS

Korean Intellectual Property Office, Notification of Transmittal of the ISR & WO (Forms ISA/220, ISA/210, ISA/237 (9 pages) issued by International Search Authority in International Application No. PCT/US2012/027811, which corresponds to the instant application.

(Continued)

*Primary Examiner* — Giovanna Wright
(74) *Attorney, Agent, or Firm* — Mary M. Lee

(57) ABSTRACT

A method and apparatus for delivering repetitive jarring impacts to a stuck object downhole. The jarring tool is deployed on coiled tubing or other tubular well conduit, and fluid pressure is used to cycle the jar without reciprocating the well conduit at the wellhead. A hydraulic reset assembly is included. The hydraulic chamber is in fluid communication with the flow path through the tool. Thus, when the internal fluid pressure inside the tool exceeds the external pressure in the well, the fluid pressure drives the piston in the hydraulic chamber to urge the tool toward the contracted position. In this way, the reset assembly can overcome the tendency of fluid pressure to extend the tool. The reset assembly can be configured to equalize the extension pressure, to prevent undesired cocking of the tool, or to overcome the extension pressure to contract the tool for recocking the jar mechanism.

7 Claims, 8 Drawing Sheets

U.S. PATENT DOCUMENTS

| | | | |
|---|---|---|---|
| 4,261,427 | A | 4/1981 | Sutliff et al. |
| 4,361,195 | A | 11/1982 | Evans |
| 4,456,081 | A | 6/1984 | Newman |
| 4,462,471 | A | 7/1984 | Hipp |
| 4,524,838 | A | 6/1985 | Sutliff |
| 4,607,692 | A | 8/1986 | Zwart |
| 4,865,125 | A | 9/1989 | De Cuir |
| 4,958,691 | A | 9/1990 | Hipp |
| 4,979,577 | A | 12/1990 | Walter |
| 5,007,479 | A | 4/1991 | Pleasants et al. |
| 5,012,871 | A | 5/1991 | Pleasants et al. |
| 5,033,557 | A | 7/1991 | Askew |
| 5,086,853 | A | 2/1992 | Evans |
| 5,094,303 | A | 3/1992 | Jenne |
| 5,117,922 | A | 6/1992 | Baron |
| 5,123,493 | A | 6/1992 | Wenzel |
| 5,139,086 | A | 8/1992 | Griffith, Sr. |
| 5,156,223 | A | 10/1992 | Hipp |
| 5,174,393 | A | 12/1992 | Roberts et al. |
| 5,211,241 | A | 5/1993 | Mashaw, Jr. et al. |
| 5,226,487 | A | 7/1993 | Spektor |
| 5,318,139 | A | 6/1994 | Evans |
| 5,327,982 | A | 7/1994 | Trahan et al. |
| 5,330,018 | A | 7/1994 | Griffith |
| 5,411,107 | A | 5/1995 | Hailey et al. |
| 5,413,185 | A | 5/1995 | Kayes |
| 5,447,196 | A | 9/1995 | Roberts |
| 5,495,902 | A | 3/1996 | Hailey et al. |
| 5,503,228 | A | 4/1996 | Anderson |
| 5,584,353 | A | 12/1996 | Chancey et al. |
| 5,595,244 | A | 1/1997 | Roberts |
| 5,595,253 | A | 1/1997 | Martin et al. |
| 5,603,383 | A | 2/1997 | Wentworth et al. |
| 5,624,001 | A | 4/1997 | Evans |
| 5,647,446 | A | 7/1997 | Wenzel |
| 5,794,718 | A | 8/1998 | Zollinger et al. |
| 5,803,182 | A | 9/1998 | Bakke |
| 5,906,239 | A | 5/1999 | Oettli |
| 5,918,688 | A | 7/1999 | Evans |
| 5,918,689 | A | 7/1999 | Roberts |
| 5,931,242 | A | 8/1999 | Oettli |
| 5,968,312 | A | 10/1999 | Sephton |
| 5,984,028 | A | 11/1999 | Wilson |
| 6,035,954 | A | 3/2000 | Hipp |
| 6,047,778 | A | 4/2000 | Coffman et al. |
| 6,050,346 | A | 4/2000 | Hipp |
| 6,050,347 | A | 4/2000 | Jenne |
| 6,053,261 | A | 4/2000 | Walter |
| 6,062,324 | A | 5/2000 | Hipp |
| 6,152,222 | A | 11/2000 | Kyllingstad |
| 6,164,393 | A | 12/2000 | Bakke |
| 6,202,767 | B1 | 3/2001 | Friis |
| 6,263,986 | B1 | 7/2001 | Massner et al. |
| 6,269,889 | B1 | 8/2001 | Wentworth |
| 6,290,004 | B1 | 9/2001 | Evans |
| 6,315,063 | B1 | 11/2001 | Martini |
| 6,439,318 | B1 | 8/2002 | Eddison et al. |
| 6,439,866 | B1 | 8/2002 | Farkas et al. |
| 6,474,421 | B1 | 11/2002 | Stoesz |
| 6,564,868 | B1 | 5/2003 | Ferguson et al. |
| 6,675,909 | B1 | 1/2004 | Cowart et al. |
| 6,712,134 | B2 | 3/2004 | Stoesz |
| 6,725,932 | B2 | 4/2004 | Taylor et al. |
| 6,782,951 | B2 * | 8/2004 | Taylor et al. ..... 166/374 |
| 6,948,560 | B2 | 9/2005 | Marsh |
| 7,066,251 | B2 | 6/2006 | Streater et al. |
| 7,066,263 | B1 | 6/2006 | Mouton |
| 7,163,058 | B2 | 1/2007 | Bakke |
| 7,293,614 | B2 | 11/2007 | Rose |
| 7,347,287 | B2 | 3/2008 | Chancey |
| 7,814,995 | B2 | 10/2010 | Clausen et al. |
| 8,066,059 | B2 | 11/2011 | Ferguson et al. |
| 2002/0027005 | A1 | 3/2002 | McNeilly et al. |
| 2003/0209349 | A1 | 11/2003 | Taylor et al. |
| 2006/0201675 | A1 | 9/2006 | Ferguson et al. |
| 2008/0236894 | A1 | 10/2008 | Clausen et al. |
| 2010/0276204 | A1 | 11/2010 | Connell et al. |
| 2011/0114316 | A2 | 5/2011 | Ferguson et al. |
| 2011/0259602 | A1 | 10/2011 | Britton |
| 2011/0315403 | A1 | 12/2011 | Nard et al. |
| 2012/0024519 | A1 | 2/2012 | Ferguson et al. |
| 2012/0024538 | A1 | 2/2012 | Britton |
| 2012/0031615 | A1 | 2/2012 | Connell et al. |
| 2012/0227970 | A1 * | 9/2012 | Schultz et al. ..... 166/301 |

OTHER PUBLICATIONS

Bowen Tools Division, IRI International Corporation, "Bowen Hydraulic Up/Down Coiled Tubing Jar," Instruction Manual (24 pages) , 1998, Bowen Tools Division, IRI International Corporation, Houston, Texas, USA.

* cited by examiner

JARRING METHOD AND APPARATUS USING FLUID PRESSURE TO RESET JAR

FIELD OF THE INVENTION

The present invention relates generally to downhole tools and methods and more particularly, but without limitation, to tools and methods used to deliver jarring impacts to objects downhole.

DETAILED DESCRIPTION OF THE PREFERRED EMBODIMENT(S)

Jarring tools are used to jar or shake loose a downhole tool or object that has become stuck or lodged in the well bore. In hydraulic or reciprocating type jars, a metering or release section inside telescopically arranged inner and outer tubular members resists allowing the jar to extend, which provides sufficient time for the tubing string to be stretched before a hydraulic release mechanism within the jar allows rapid extension and impact within the tool. This creates a large dynamic load on the stuck tool or object. Most hydraulic jars are designed for repetitive or cyclic action to continue jarring the stuck object until it is dislodged. The cyclic firing and resetting or recocking of the jar is accomplished by pushing and pulling the tubing string.

Hydraulic jars are often run on coiled tubing. However, there are several disadvantages to using coiled tubing to run a hydraulic jar. It is particularly difficult to push or "snub" coiled tubing into a horizontal well, making it difficult to cycle the jar.

Additionally, problems may arise related to the wear and tear on the tubing. Each time the coiled tubing passes through the surface equipment (the injector head, etc.) used to secure and seal the coiled tubing at the wellhead, the tubing undergoes stress and strain. This substantially reduces the service life of the tubing. During a hydraulic jarring operation, the same small section of the coiled tubing is subject to repeated high-load cycles, which can rapidly degrade the condition of the tubing at this section and thus compromise the entire operation and indeed the well. This is especially true in the case of high pressure wells; the high pressure loads put even more stress on the tubing. When the tubing becomes worn, the degraded section must be removed or replaced, which is both time consuming and expensive. Under some high pressure conditions, the coiled tubing may be limited to only three to four jar cycles.

The jarring tool of the present invention offers an improvement in methods and tools for jarring operations using coiled tubing. In accordance with the method of the present invention, the jar is cycled using fluid pressure; repeatedly raising and lowering of the coiled tubing is eliminated. This is made possible by including one or more hydraulic pressure chambers in the tool in addition to the jar assembly. Although the jarring tool and method of this invention is particularly useful with coiled tubing, those skilled in the art will appreciate that it can be employed with other tubular well conduits, such as jointed well tubing and drill pipe. conduits, such as jointed well tubing and drill pipe.

Figure 1:
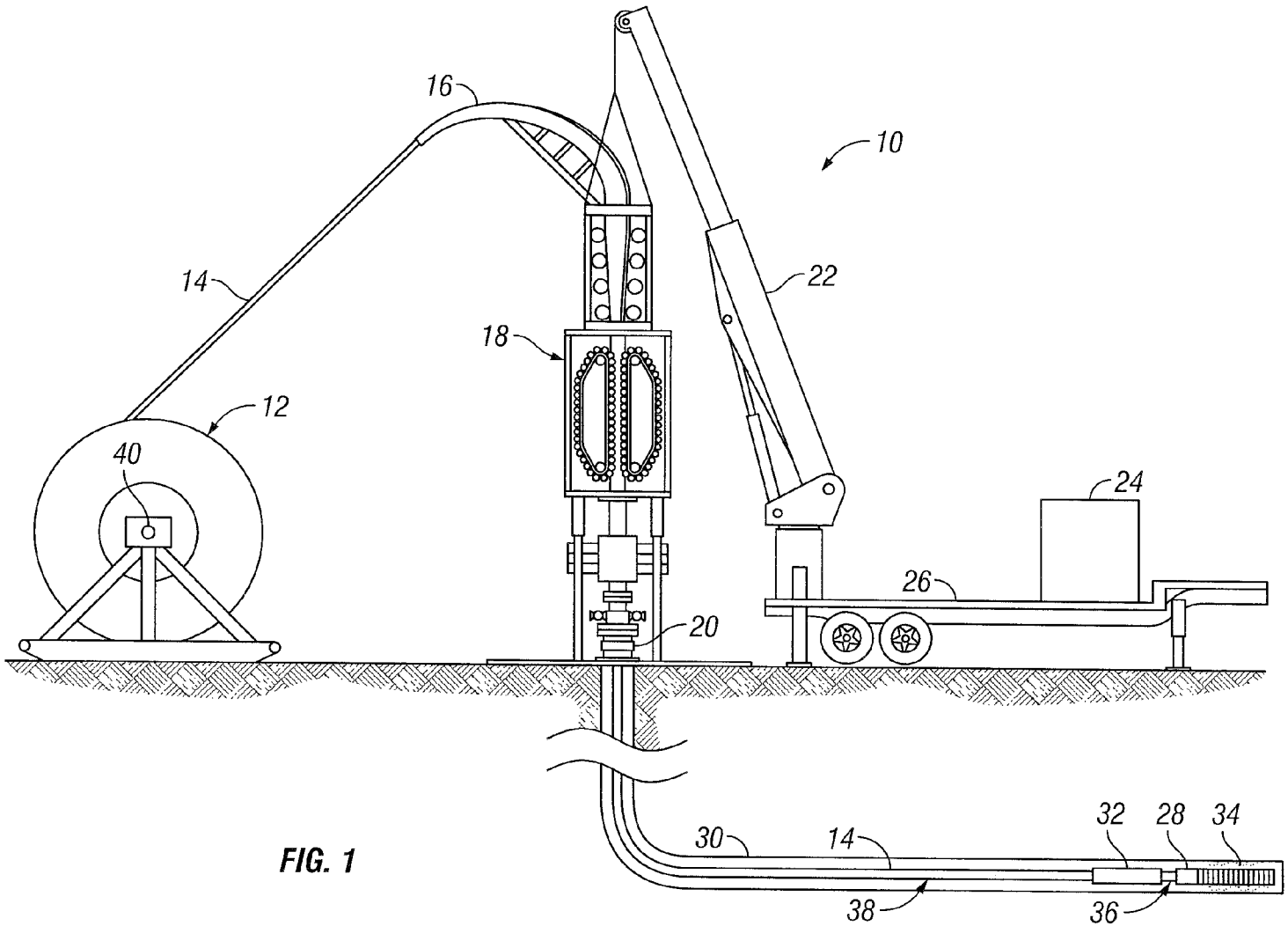
FIG. 1 is a schematic illustration of a typical coiled tubing system.

Turning now to the drawings in general to and to FIG. 1 in particular, there is shown therein a typical coiled tubing deployed jarring system. The exemplary system or "rig," designated generally by the reference number 10, includes surface equipment. The surface equipment includes a reel assembly 12 for dispensing the coiled tubing 14. An arched guide or "gooseneck" 16 guides the tubing 14 into an injector assembly 18 supported over the wellhead 20 by a crane 22. The crane 22 as well as a power pack 24 may be supported on a trailer 26 or other suitable platform, such as a skid or the like. A control cabin, as well as other components not shown in FIG. 1 may also be included.

A fishing tool 28 on the end of the tubing 14 in the wellbore 30 is used to attach a jar 32 to the stuck object 34. The combination of tools connected at the downhole end of the tubing 14 forms a bottom hole assembly 36. The bottom hole assembly 36 and tubing combined are referred to herein as the tubing string 38. The bottom hole assembly 36 may include a variety of tools including but not limited to a bit, a mud motor, hydraulic disconnect, jarring tools, back pressure valves, and connector tool.

Fluid is introduced into the coiled tubing 14 through a system of pipes and couplings in the reel assembly, designated herein only schematically at 40. In accordance with conventional techniques, the jar 26 is cycled by raising and lowering the section of tubing in the injector assembly 18 repeatedly until the object 34 is dislodged.

In some instances, the jar 26 is connectable directly to the stuck object 34 in the wellbore 30. In other instances, the jar 26 is connected as one member of a bottom hole assembly comprising several tools. When the jar 26 is described as being connectable to a "stationary object downhole," it is intended to mean that the tool is connectable to another tool in the tool string, which may have become lodged in the wellbore, or to the fishing tool 28 that is in turn attached to the stuck object 34 in the well, or even directly to the stuck object.

The coiled tubing injection system 10 illustrated in FIG. 1 is exemplary. It is not intended to be limiting. There are several types of tubing injection systems presently available, and the method and apparatus of the present invention may be used with equal success in any of these systems.

Figure 2:
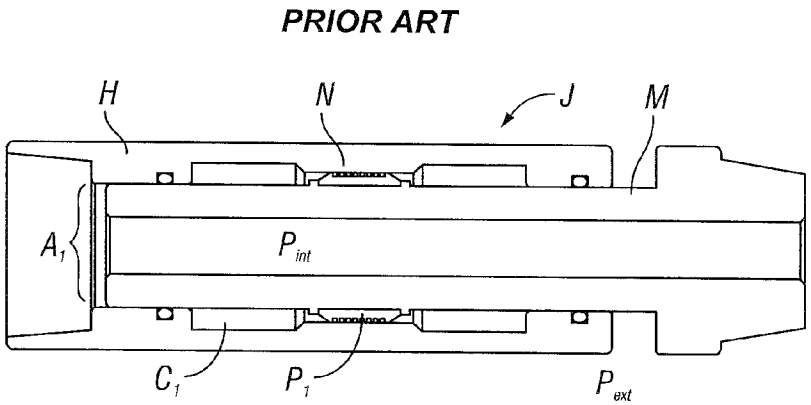
FIG. 2 is a diagrammatic illustration of a typical hydraulic jarring too.

FIG. 2 is a diagrammatic illustration of a tubing deployed hydraulic jarring tool J. A tubular mandrel M is telescopically received inside a housing H. The lower end of the mandrel is attached to the stuck object, and the upper end of the housing is attached to the downhole end of the tubing. A hydraulic chamber $C_1$ is formed in the sidewall of the housing with a narrow diameter portion N dividing the hydraulic chamber into upper and lower potions. A piston $P_1$ riding on the mandrel moves axially inside the chamber as the coiled tubing string is lifted and lowered.

The jar is set or cocked by "slacking off" on the tubing string to allow downward movement of the housing on the mandrel forcing the piston past the narrow portion into the upper chamber. The jar is fired by raising the tubing, which pulls the piston back through the narrow portion of the chamber. As the piston moves into the lower chamber, a sudden pressure release creates a jarring impact in the tool. This process is repeated until the stuck object is dislodged.

The surface area on the end of the mandrel exposed to the fluid entering the tool is designated as $A_1$. When the internal pressure of the flow through the tool exceeds the fluid pressure in the wellbore, the force exerted by fluid pressure inside the tool tends to extend the tool. This is referred to as the Pressure Induced Extension Force ("PIEF") and may be expressed by the following formula, where $P_{int}$ represents the internal fluid pressure and $P_{ext}$ represents the external fluid pressure in the wellbore:

$$\text{PIEF}=A_1\times(P_{int}-P_{ext}).$$

Thus, the PIEF for a standard 2.88 short stroke jar, such as the one shown in FIG. 2, in which the area $A_1$ is 1.77 square inches, the PIEF can be determined by the formula:

$$\text{PIEF}=1.77\times(P_{int}-P_{ext}).$$

Figure 3:
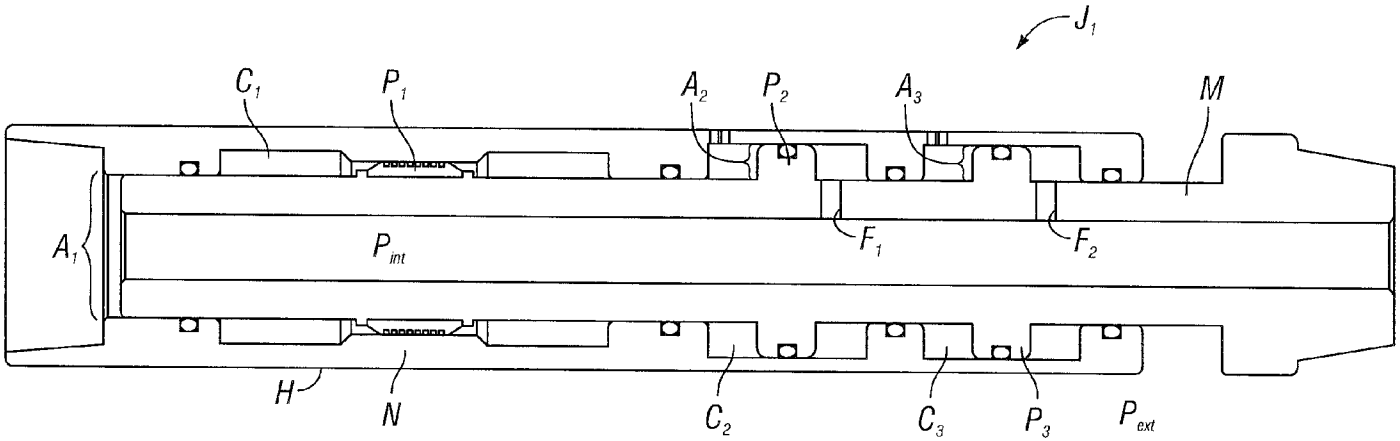
FIG. 3 is a diagrammatic illustration of an "over balanced" jarring tool made in accordance with a preferred embodiment of the present invention.

FIG. 3 is a diagrammatic illustration of a first embodiment of the tool of the present invention. The structure of the tool $J_1$ may be similar to the tool described in FIG. 2 insofar as the jarring mechanism is concerned. However, it will be understood that other types of jar assemblies could be employed. Alternate jar types include mechanical jars, spring-operated jars, and electronically released jars. In addition, any other jar type that requires a substantial resetting force which with the hydraulic resetting method and hydraulic reset system described here may be reset without moving the tubing at the surface. As shown in FIG. 3, a tubular mandrel M is telescopically received inside a housing H. The lower end of the mandrel is attached to the stuck object, and the upper end of the housing is attached to the downhole end of the tubing.

The inventive tool includes a hydraulic reset system to provide a pressure-induced contraction force ("PICF") that is counteractive to PIEF when the internal pressure exceeds the wellbore pressure. To that end, two additional hydraulic chambers $C_2$ and $C_3$ are created by annular recesses in the sidewall of the H, and two pistons $P_2$ and $P_3$ are formed on the outer perimeter of the mandrel.

The hydraulic chambers $C_2$ and $C_3$ are fluidly connected to the lumen of the mandrel by fluid ports $F_1$ and $F_2$. below (downhole) of the pistons $P_2$ and $P_3$ Thus, fluid pressure on the surface areas in these chambers, designated as $A_2$ and $A_3$, respectively, is a pressure-induced contraction force that tends to move the housing down relative to the mandrel, that is, it tends to contract the tool. Thus, by selecting the dimensions of the tool components, an "over-balanced" tool is made in which fluid pressure can be employed to reset or re-cock the jarring mechanism in the tool.

The hydraulic operation of the tool shown in FIG. 3 is expressed by the following formula, where $P_{int}$ represents the internal fluid pressure and $P_{ext}$ represents the external fluid pressure in the wellbore, and PIF represents the net pressure induced force in the tool:

$$\begin{aligned} PIF &= [A_1\times(P_{int}-P_{ext})]-[A_2\times(P_{int}-P_{ext})]-[A_3\times(P_{int}-P_{ext})] \\ &= [A_1-A_2-A_3)\times(P_{int}-P_{ext})]. \end{aligned}$$

Now it will be understood that if $A_1>A_2+A_3$ and $P_{int}>P_{ext}$, then the net pressure-induced force, PIF, tends to extend the tool, that is, the PIEF exceeds the PICF. Whereas, if $A_1<A_2+A_3$ and $P_{int}>P_{ext}$, then the net force PIF tends to contract the tool, that is, the contraction force exceeds the extension force. It will be noted that the number of additional hydraulic chambers exerting an "up" force may vary as may the relative dimensions of the tool and its component parts.

In some cases, it is advantageous to have a jarring tool where the net extension and contraction forces are balanced, that is, where the net extension/contraction force, PIF, on the tool is zero. For example, if the jar is under balanced (PIF creates an extension force) the occurrence of high internal fluid pressures (which can occur during pumping) can cause the pressure-induced force on $A_1$ to become so high that the mandrel and housing expand making it difficult or impossible to reset the jar. By providing an additional hydraulic chamber configured to provide a balancing force in the opposite direction, unwanted extension of the jar is avoided.

Figure 4:
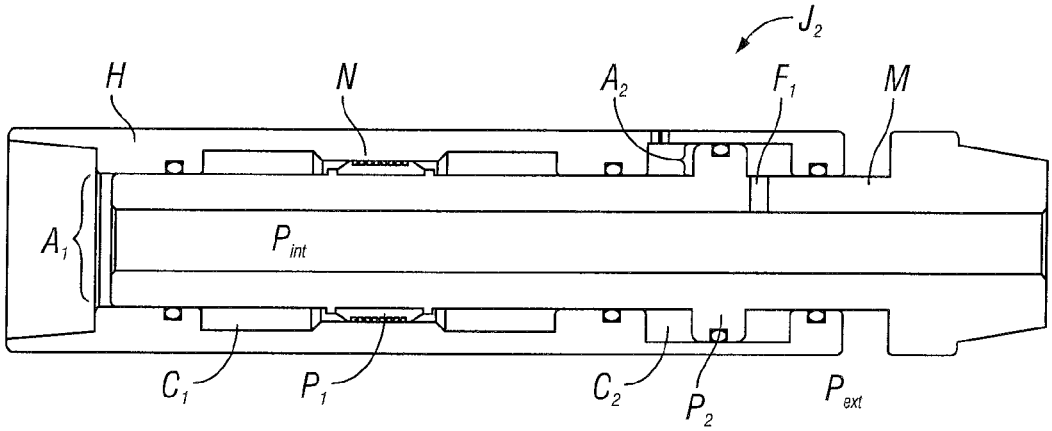
FIG. 4 is a diagrammatic illustration of a "balanced" jarring tool made in accordance with a second preferred embodiment of the present invention.

A diagrammatic depiction of a balanced tool is shown in FIG. 4. The structure of the tool $J_2$ is similar to the tools J and $J_1$, described in FIGS. 2 and 3, insofar as the jarring mechanism is concerned. A tubular mandrel M is telescopically received inside a housing H. The lower end of the mandrel is attached to the stuck object, and the upper end of the housing is attached to the downhole end of the tubing.

However, the hydraulic system provides a PICF that is equal to the PIEF. To that end, one additional hydraulic chamber $C_2$, piston $P_2$ and fluid port $F_1$ is provided so that $A_2$ equals $A_1$. By selecting the dimensions of the tool components, a "balanced" tool is made in which fluid pressure does not affect the resetting of the tool. Additionally, this balanced jar would allow back-pressure valves to be run above or below the jar in the bottom hole assembly without creating hydraulic locking issues if the flow path below the tool becomes plugged.

Figure 5A:
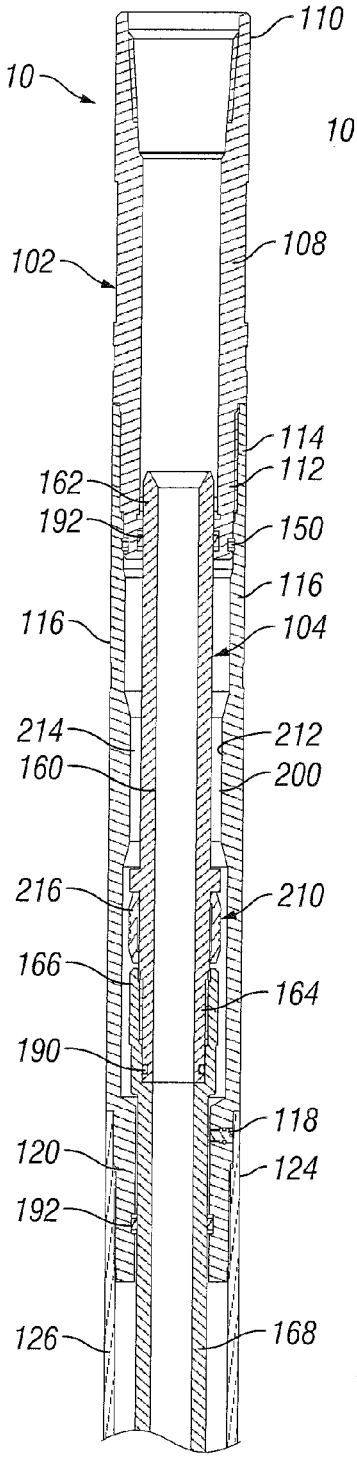
FIGS. 5A-5C are sequential fragmented sectional views of the jarring tool of FIG. 3.
Figure 5B:
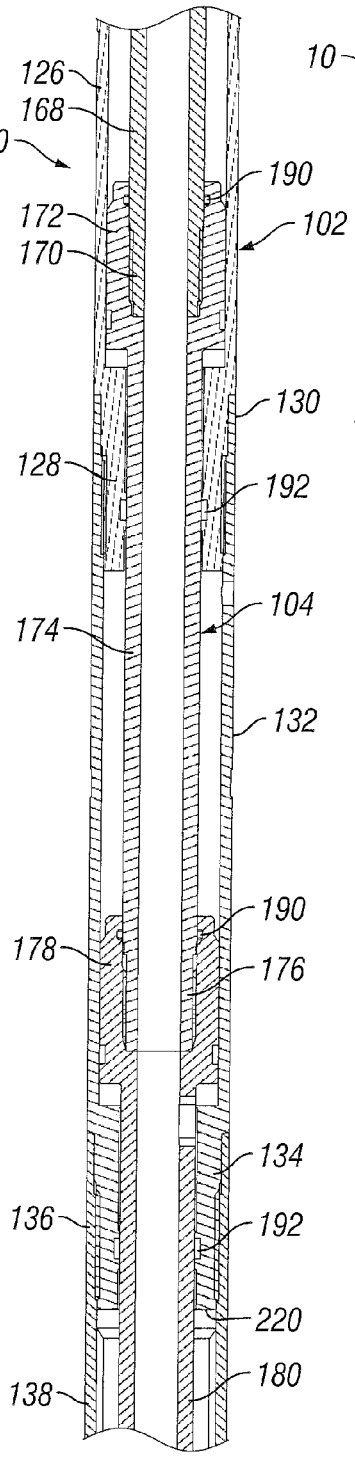
Figure 5C:
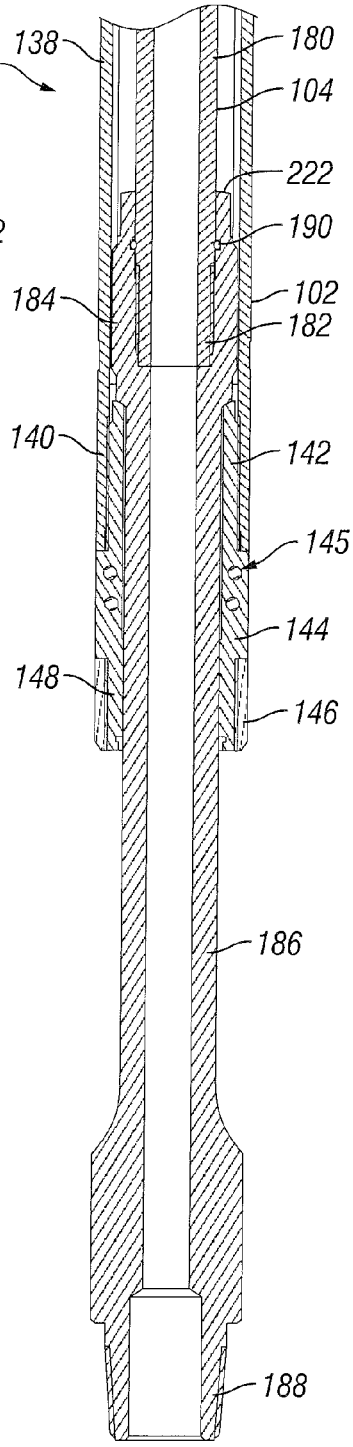

Having explained the hydraulic principles related to the present invention, one preferred embodiment of the jarring tool will described in more detail with references to FIGS. 5A-5C. Shown therein is a jarring tool made in accordance with a preferred embodiment of the present invention and designated generally by the reference numeral 10. The jarring tool 10 is attachable to a tubular well conduit, such as the coiled tubing 14 (FIG. 1) jointed well tubing, or drill pipe, for delivering an impact to an object 34 downhole.

In its preferred form, the jarring tool 100 generally comprises a housing such as the outer tubular assembly 102 and an inner tubular assembly 104. The inner tubular assembly 104 is telescopically received inside the outer tubular assembly 102. One of the tubular assemblies is connectable to well conduit, and the other is attachable to the downhole object.

In the embodiment shown, the inner tubular assembly 104 comprises a lower or downhole end that connects directly or by means of intervening tools to the stationary object 34 downhole, and the outer assembly 102 has an upper end that attaches to the coil tubing or other well conduit 14. In this way, the outer assembly 102 is movable up or down relative to the inner assembly 104. However, it will be appreciated that this arrangement may be reversed, that is, the outer assembly may be attachable to the downhole object 34 (or other tool 28) and the inner assembly attachable to the well conduit 14. A flow path 106 extends through tool 100 to allow fluid to pass from the coiled tubing 14 through the tool.

As used herein, the terms "up," "upward," "upper," and "uphole" and similar terms refer only generally to the end of the drill string nearest the surface.

Similarly, "down," "downward," "lower," and "downhole" refer only generally to the end of the drill string furthest from the well head. These terms are not limited to strictly vertical dimensions. Indeed, many applications for the tool of the present invention include non-vertical well applications.

Throughout this specification, the outer and inner tubular assemblies 102 and 104 and the jarring assembly components are described as moving "relative" to one another. This is intended to mean that either component may be stationary while the other is moved. Similarly, where a component is referred to as moving "relatively" downwardly or upwardly, it includes that component moving downwardly as well as the other, cooperative component moving upwardly.

Both the outer tubular assembly 102 and inner tubular assembly 104 preferably are composed of several interconnected tubular members. The number and configuration of these tubular members may vary. Preferably all these members are interconnected by conventional threaded joints, but other suitable connections may be utilized.

Shown in FIGS. 5A-5C is a preferred construction. The outer tubular assembly 102 comprises a first member such as the top sub 108 having an upper end 110 connectable to the coiled tubing or other well conduit 14 (FIG. 11). The lower end 112 of the top sub 108 connects to a second member such as the upper end 114 of an oil port sub 116. An oil port 118 with a pipe plug is provided in the lower end 120 of the oil port sub 116.

The lower end 120 of the oil port sub 116 connects to a third member such as the upper end 124 of an upper piston housing 126. The lower end 128 of the upper piston housing 126 connects to a fourth member such as the upper end 130 of a lower piston housing 132. The lower end 134 of lower piston housing 132 connects to a fifth member, such as the upper end 136 of a spline housing 138. The lower end 140 of the spline housing 138 connects to a sixth member such as the upper end 142 of a split end cap 144, secured together by bolts (not shown) through the transverse bolt holes 145 (FIG. 5C). An S.E.C. retainer ring 146 is provided on the lower end 148 of the end cap 144, which forms the lowermost end of the outer tubular assembly 102.

The top sub 108, the oil port sub 116, the upper piston housing 126, the lower piston housing 132, the spline housing 138, and the end cap 144 all are interconnected with threaded joints for fixed movement with the coil tubing or other well conduit 14. Those joints forming part of fluid chambers are equipped with seals, such as O-rings, designated collectively by the reference number 150.

With continued reference to FIGS. 5A-C, the preferred inner tubular assembly 104 comprises an upper mandrel 160 with an upper end 162 telescopically received in the top sub 108 of the outer tubular assembly 102. Connected to the lower end 164 of the upper mandrel 160 is the upper end 166 of a center mandrel 168. The lower end 170 of the center mandrel 168 is attached to the upper end 172 of an upper piston mandrel 174. The lower end 176 of the upper piston mandrel 174 is attached to the upper end 178 of a lower piston mandrel 180, the lower end 182 of which is attached to the upper end 184 of a lowermost mandrel or bottom sub 186. The lower end 188 of the bottom sub 186 is connectable, such as by threads, to another tool, such as the fish 28 that may be attached to the stuck object 34 in the wellbore 30 (FIG. 1).

The upper mandrel 160, the center mandrel 168, the mandrel 86, the upper and lower piston mandrels 174 and 180, and the bottom sub 186 all are connected together for fixed movement with the object in the well. Thus, axial movement of the coil tubing 14, or other well conduit, causes the outer assembly 102 to move relative to the inner assembly 104. Preferably, these members are interconnected by conventional threaded joints, but other suitable connections may be utilized. Those joints forming part of fluid chambers are equipped with seals, such as O-rings, designated collectively by the reference number 190. Additionally, seal members, such as backup rings 192 are provided between the inner and outer tubular members 102 and 104 to provide a fluid tight but sliding engagement therebetween.

The outer diameter of the inner tubular assembly 104 and the inner diameter of the outer tubular assembly 102 are configured to provide an annular hydraulic chamber 200 therebetween for the jarring mechanism yet to be described. This hydraulic chamber 200, seen best in FIGS. 6A & 6B, extends from the lower end 112 of the top sub 108 into the lower end 120 of the top.

Figure 6A:
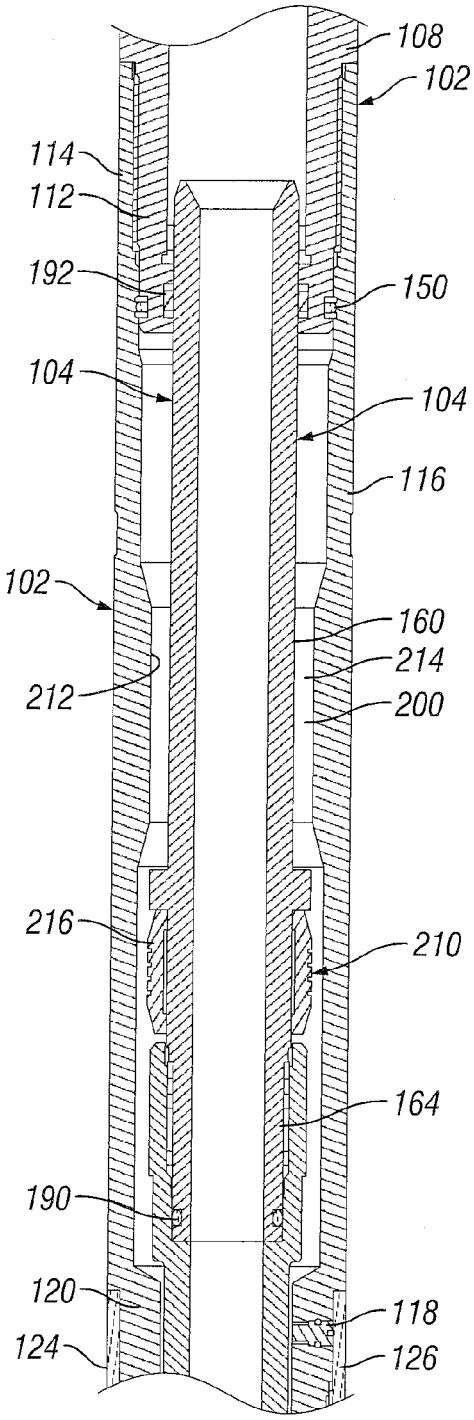
FIGS. 6A and 6B are longitudinal sectional views of the tool of FIGS. 5A-5C showing the jarring assembly in the fired or discharged position and in the pre-jar or cocked position, respectively.
Figure 6B:
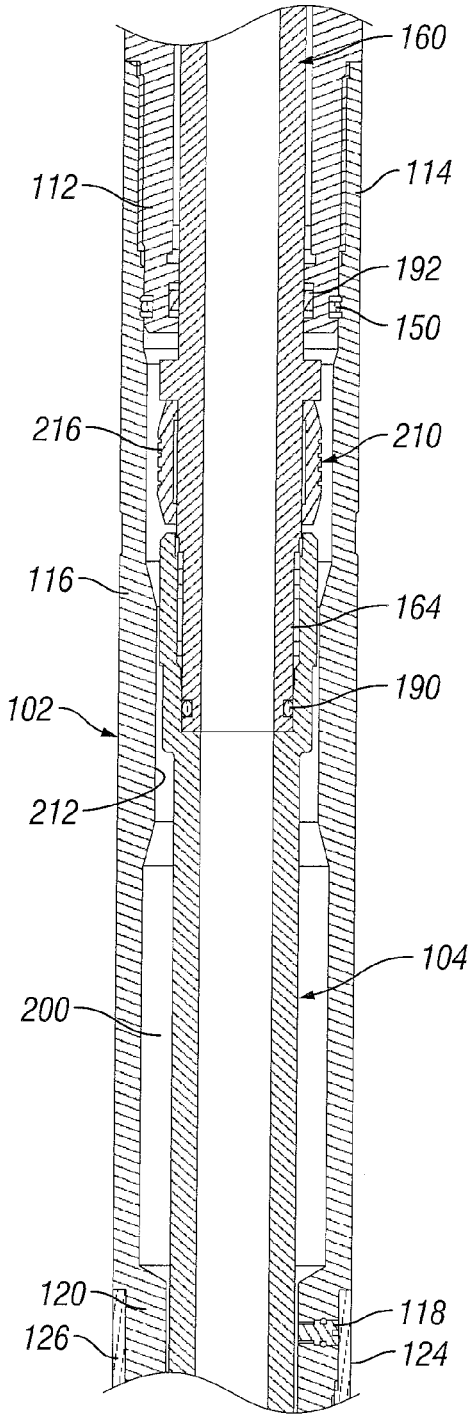

With continuing reference to FIGS. 5A, 6A and 6B, the jarring assembly 210 is disposed inside the hydraulic chamber 200. As indicated above, this jarring assembly is a one-way hydraulic jar configured to provide an upward jar or impact. The tool could be reconfigured to provide downward jarring impacts. Still further, a bidirectional jar could be employed. One preferred bidirectional jar that may be employed in the tool of the present invention is shown and described in U.S. Pat. No. 8,230,912, issued Jul. 31, 2012, and entitled "Hydraulic Bidirectional Jar." The contents of this patent are incorporated herein by reference.

Since the jarring assembly shown is well known, its structure and operation will be summarized. The jarring assembly 210 comprises a restricted section 212 positioned within the hydraulic chamber 200, and preferably on the inner wall of the outer assembly 102 that forms the outer wall of the hydraulic chamber. More specifically, the restricted section 212 in this embodiment is provided by a reduced diameter section on the inner surface of the oil port sub 116.

As seen in FIGS. 5A and 6A, the outer surface of the center mandrel 168 and the inner surface of the reduced diameter section 212 form a narrow fluid flow passage 214 generally dividing the hydraulic chamber 200 into upper and lower chambers and permitting fluid to flow therebetween. A piston 216 "floats" or rides on the outer wall of the upper mandrel 160. A small bleed channel 220 formed in the piston 216 allows a small amount of fluid to be squeezed through the piston 216 as it moves through the narrow passage 214.

The outer diameter of the piston 216 and the inner diameter of the restricted section 212 are selected to create resistance as the piston passes through the restricted section. Once the restricted section clears the end of the piston 216, the resistance drops and full flow resumes, resulting in an upward jar. As shown in FIGS. 5B, 5C, and 9A and 9B, the end face on the upper end 142 of the end cap 140 forms a hammer surface 220 that impacts the anvil shoulder or surface 222 formed around the bottom of the upper end 184 of the bottom sub 186.

Figure 7A:
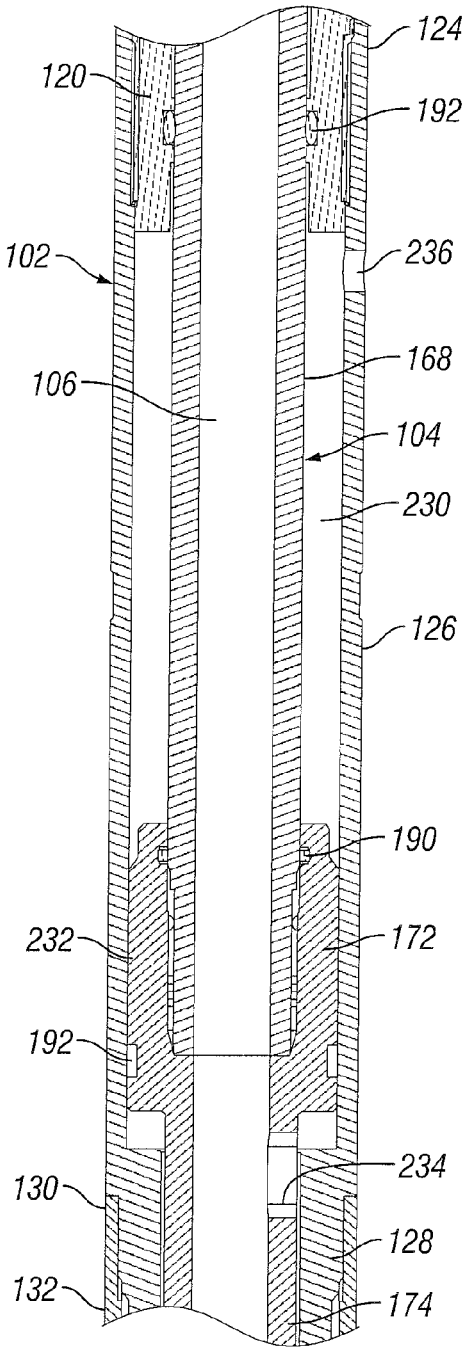
FIGS. 7A and 7B are longitudinal sectional views of the tool of FIGS. 5A-5C showing the first reset assembly in the post-jar or discharged position and in the pre-jar or cocked, respectively.
Figure 7B:
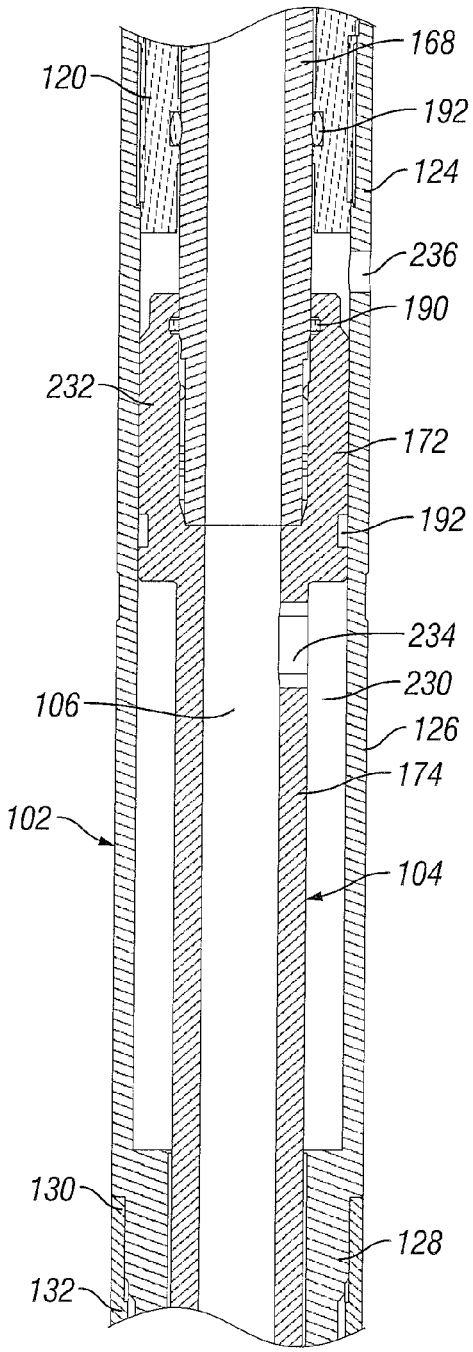

In the preferred "overbalanced" tool shown and described herein, the contraction force is generated by two hydraulic reset assemblies. The uppermost reset assembly is shown in FIGS. 7A and 7B. The dimensions of the inner and outer tubular assemblies 102 and 104 are selected to provide a first fluid chamber 230 and a first piston 232 movable axially inside the chamber 230. A port 234 fluidly connects the fluid chamber 230 with the flow path 106. An external port 236 is provided in the sidewall of the upper piston housing 126 for releasing fluid from the chamber 230.

Figure 8A:
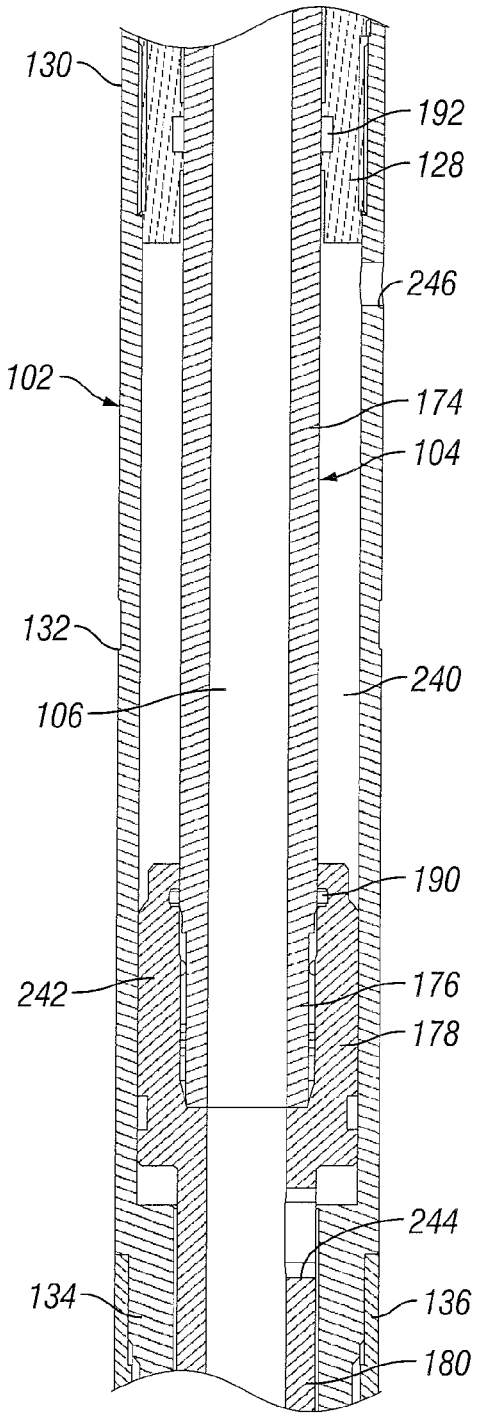
FIGS. 8A and 8B are longitudinal sectional views of the tool of FIGS. 5A-5C showing the second reset assembly in the post-jar or discharged position and in the pre-jar or cocked position, respectively.
Figure 8B:
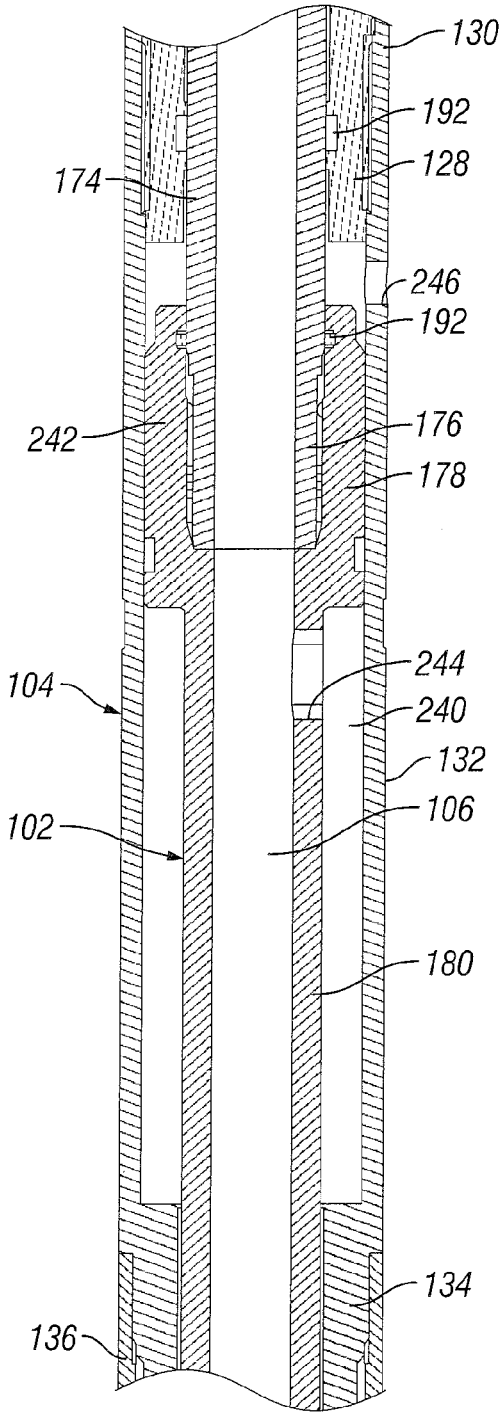

The second, lowermost reset assembly is shown in FIGS. 8A and 8B. A second fluid chamber 240 contains a second piston 242 movable axially inside the chamber 240. A port 244 fluidly connects the fluid chamber 240 with the flow path 106. An external port 246 is provided in the sidewall of the piston housing 132 for releasing fluid from the chamber 240.

As fluid is forced into the coiled tubing 14 to a predetermined pressure to achieve an internal pressure greater than the external pressure, depending on the dimensions of the tool, the fluid exerts a force that moves the pistons 232 and 242 from the neutral position shown in FIGS. 7A and 8A to the deployed or extended position shown in FIGS. 7B and 8B. This, of course, moves the entire outer tubular assembly 102 to cock or reset the hammer assembly 210. When the hammer assembly 210 fires, the pistons 232 and 242 (and outer tubular assembly 102) resume the neutral position.

To permit transmission of torque through the tool 100, the tool may include some anti-rotation structure between the outer and inner tubular assemblies 102 and 104. For example, interengaging splines, designated generally at 260 and 262 in FIGS. 9A and 9B, may be provided on the inner surface of the spline housing 138 and the outer surface of the upper end 184 of the bottom sub 186. This will allow axial movement but prevent rotational movement between the outer and inner tubular assemblies 102 and 104.

Figure 9A:
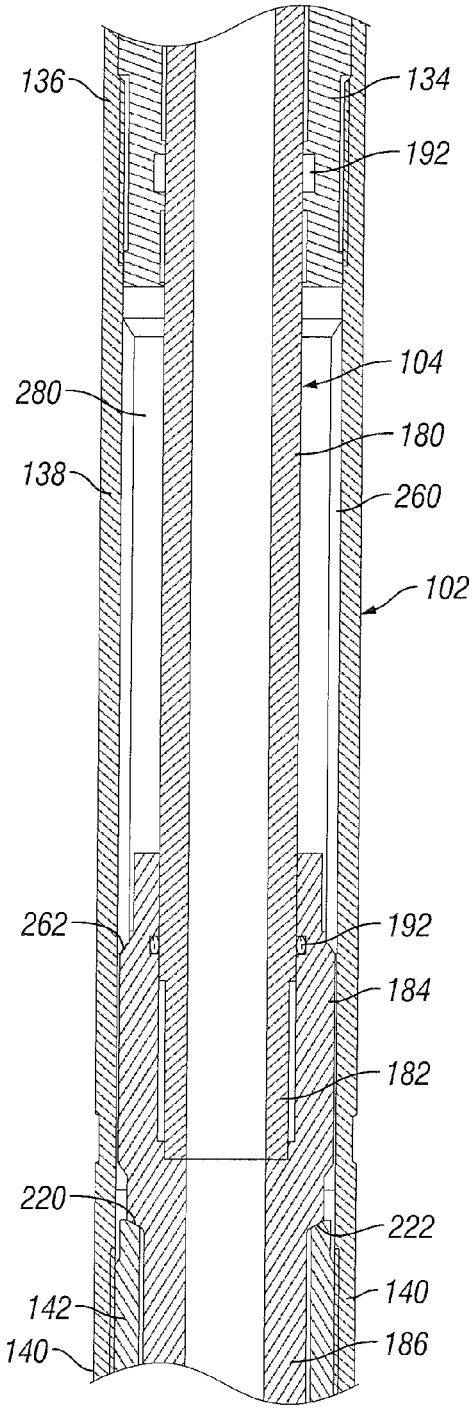
FIGS. 9A and 9B are longitudinal sectional views of the tool of FIGS. 5A-5C showing the torque transmitting section in the post-jar or discharged position and in the cocked position and discharged position, respectively.
Figure 9B:
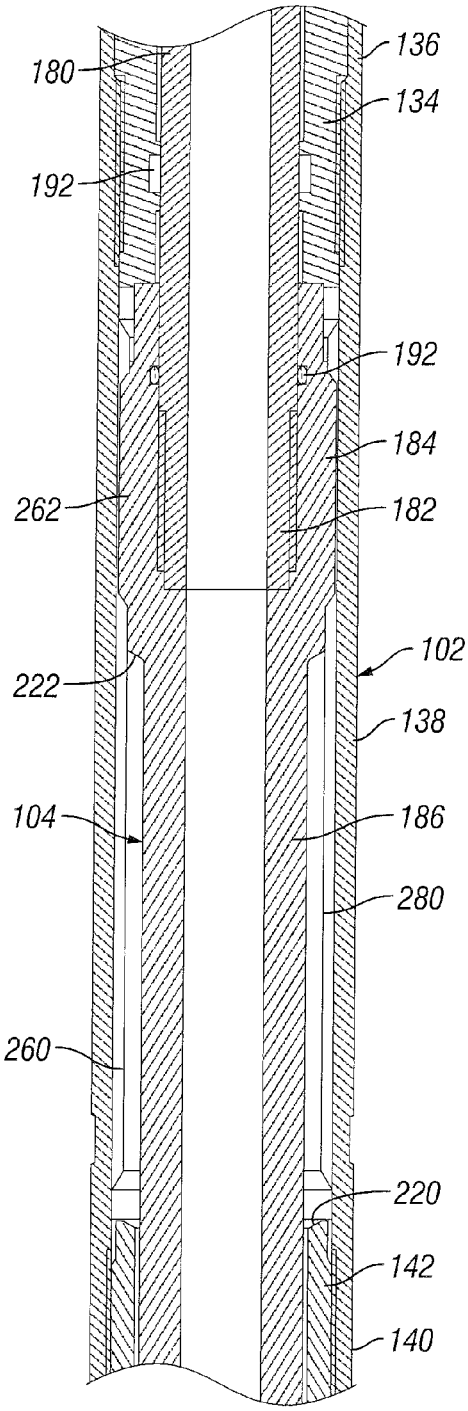

Referring still to FIGS. 9A and 9B, there is an elongate annular space 280 formed between the outer and inner tubular assemblies 102 and 104 to allow for the telescopic movement. This pressure equalization chamber 280 may be ported to the wellbore 30 (FIG. 1) so that well fluids can fill the chamber and balance the pressure in the hydraulic fluid chamber 200 of the jarring assembly 210. The ports (not shown), the number and position of which may vary, may be screened to prevent entry of particulate matter.

Having described the structure of the tool 100, its use and operation in accordance with a preferred embodiment of the method of the present invention now will be explained. The tubing string 38 is run downhole and latched onto the stuck object 34 preferably using the fish 28.

Next, striking tension is applied to the tubing 14 using the injector assembly 18. "Striking tension" means the tension necessary to extend and maintain the tool in the extended position, thereby maintaining the jar assembly in the fired or discharged position. Once the striking tension is achieved, the tubing 14 is secured or locked in the injector assembly 18 to prevent reciprocal movement of the tubing. Where the jarring tool is deployed or conveyed on jointed well tubing or drill pipe, the well conduit support assembly may include slips or a "dog collar" to secure the conduit above the wellhead, instead of a coiled tubing injector assembly.

With tubing string secured, fluid is introduced to pressurize the tubing. The pressure is increased until the desired reset pressure is achieved. Referring again to FIGS. 5A-5C, this ensures that the jar assembly 210 in the tool 100 is cocked and ready to fire. Because the tubing 14 is secured at the surface, pressurizing the hydraulic chambers in the tool pulls the outer tubular assembly 102 downward over the inner tubular assembly 104, contracting the tool 100 and stretching the tubing 14.

Next, the fluid pressure is "bled off" to release the extension. When the jar 210 fires, the outer tubular assembly 102 snaps back up and create an upward impact. After the jar assembly 210 fires, the procedure is repeated as often as necessary until the fish 28 and the stuck object 34 are jarred loose. The tubing string 38 then may be retracted to the surface.

It will be apparent that the length of the deployed tubing affects the capacity of the tubing to stretch under pressure. This, in turn, affects the length of the stroke that can be achieved in the jarring tool by stretching the tubing. If the tubing is too short, excessive tension would be required to extend the tool. Consequently, the induced load from fluid pressure will be insufficient to stroke the jar.

In such cases, in accordance with the one embodiment of the method of the present invention, fluid pressure may be used to maintain the tool in the contracted or cocked position while applying the striking tension to the coiled tubing. Then, when the striking tension is achieved, the tubing is secured in the injector assembly. Now, bleeding off the internal pressure will allow the tool to extend and cause an initial an initial jarring action. Then, the internal pressure is varied as before to cock and release the jar repeatedly.

Now it will be appreciated that the tool and method of the present invention allows jarring operations on coiled tubing with minimal wear on the tubing. Additionally, the present invention permits reliable, fluid-controlled jarring operations on coiled tubing especially in horizontal or deviated wellbores where tubing reciprocation is particularly difficult if not impossible.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts, within the principles of the invention to the full extent indicated by the broad meaning of the terms. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A jarring tool attachable to a well conduit for delivering an impact to a stationary object downhole, the tool comprising:

an outer tubular assembly;

an inner tubular assembly telescopically received in the outer tubular assembly for relative movement from a contracted position to an extended position;

wherein the inner and outer tubular assemblies define a flow path through the tool, and wherein when fluid pressure inside the tool exceeds fluid pressure in the wellbore, the fluid pressure tends to extend the tool;

wherein one of the inner and outer tubular assemblies is attachable to the well conduit and the other of the inner and outer tubular assemblies is attached to the stationary object;

a jar assembly in the tool wherein the jar assembly comprises an anvil surface and a hammer surface; and a hydraulic reset assembly in the tool comprising at least one hydraulic chamber and piston, the hydraulic chamber is in fluid communication with the flow path so that, when fluid pressure inside the tool exceeds fluid pressure in the wellbore, fluid pressure in the chamber tends to contract the tool.

2. A bottom hole assembly comprising the jarring tool of claim 1.

3. A tubing string comprising the bottom hole assembly of claim 2.

4. A coiled tubing system comprising the tubing string of claim 3.

5. The jarring tool of claim 1 wherein the jar assembly is hydraulic.

6. The jarring tool of claim 1 wherein the hydraulic reset assembly is configured to provide a contraction force that balances the extension force exerted by the fluid pressure.

7. The jarring tool of claim 1 wherein the hydraulic reset assembly is configured to provide a contraction force that overcomes the extension force exerted by the fluid pressure.

* * * * *